United States Patent [19]

Plyler et al.

[11] 4,159,160

[45] Jun. 26, 1979

[54] ELECTRICAL TERMINAL WITH ANTI-TANGLE TANGS

[75] Inventors: Robert G. Plyler, Vienna; Lyle B. Suverison, Fowler, both of Ohio

[73] Assignee: General Motors Corporation, Detroit, Mich.

[21] Appl. No.: 919,781

[22] Filed: Jun. 28, 1978

[51] Int. Cl.[2] ..... H01R 13/42

[52] U.S. Cl. ..... 339/217 S

[58] Field of Search ..... 339/217 S

[56] References Cited

U.S. PATENT DOCUMENTS

| | | | |
|---|---|---|---|
| 3,083,345 | 3/1963 | Scheller | 339/47 |
| 3,178,674 | 4/1965 | Scheller | 339/217 |
| 3,221,289 | 11/1965 | Eads | 339/217 S |
| 3,267,410 | 8/1966 | Baer et al. | 339/184 |

*Primary Examiner*—Neil Abrams
*Attorney, Agent, or Firm*—F. J. Fodale

[57] ABSTRACT

A female terminal has a channel shaped median portion provided with a latch tang and a lock tang associated with each side wall. The four tangs project inwardly to avoid damage and tangling during handling. The tangs lock the terminal in a connector body in cooperation with a projecting block in the terminal cavity. A lock bar retained on the connector body provides a positive secondary lock in cooperation with the lock tangs of the terminal.

3 Claims, 6 Drawing Figures

ELECTRICAL TERMINAL WITH ANTI-TANGLE TANGS

This invention relates generally to electrical connectors and more particularly to electrical terminals having resilient latch and rigid stop tangs for locking the terminal in a connector body cavity.

Such a terminal is generally shown in the U.S. Pat. No. 3,267,410 granted to D. G. Baer et al Aug. 16, 1966 which discloses a terminal 80 having a resilient latch tang 88 and a rigid stop tang 89. Both tangs project outwardly of the channel shaped median portion of the terminal. The outwardly projecting tangs are exposed to damage during handling and also pose a possible tangling problem in assembling wiring harnesses having several electrical wires with such terminals attached at their ends. Broadly the object of this invention is to provide a terminal having resilient latch and rigid stop tangs which project inwardly so as to avoid exposure to damage and possible tangling problems.

U.S. Pat. No. 3,083,345 granted to W. R. Scheller Mar. 26, 1963 and U.S. Pat. No. 3,178,674 granted to W. R. Scheller Apr. 13, 1965 both disclose terminals in which the latch and stop tangs project inwardly. However the arrangements disclosed in these patents are not entirely satisfactory and another broad object of this invention is to improve upon these arrangements.

The terminal 72 disclosed in FIGS. 13–22 of the Scheller U.S. Pat. No. 3,083,345 has a single latch tang 98 offset to one side of the contact arms 92 and two stop tangs 96 offset to the opposite side. The Scheller arrangement requires molding a complicated projecting block 120 in the terminal cavity of the connector body, limits the width of the stop surface on the stop tangs 96 to the stock thickness of the terminal and requires that the contact arms 92 pass between the projecting block 120 and the cavity side walls during terminal insertion.

The terminal 20 disclosed in the Scheller U.S. Pat. No. 3,178,674 has a pair of resilient arms 30 having rigid tangs 32 which serve as both forward and rearward stops. This arrangement requires molding an even more complicated projecting block (FIG. 3) in the terminal cavity, limits both the forward and rearward stop surfaces 36 and 38 to the width of the terminal stock thickness and requires that the contact arms 24 pass through narrow slots between the block portions 46 and 48 and the cavity side walls.

Neither Scheller arrangement can be used with the female type terminal disclosed in the Baer et al patent and the latter Scheller arrangement cannot be used in conjunction with a common secondary lock for the two rigid tangs.

The object of this invention is to provide improved anti-tangle tang means for locking a terminal in a connector body.

Another object of the invention is to provide improved anti-tangle tang means which are of more general application and can be incorporated into the terminals having a greater possible variety of shapes for the contact portion.

Yet another object of the invention is to provide a terminal having anti-tangle tang means which do not require a complicated cooperating projecting block in the terminal cavity of its connector body.

Still another object of the invention is to provide a terminal having anti-tangle tang means which provide an equal plurality of latch tangs and stop tangs.

Still another object of the invention is to provide a terminal having anti-tangle tang means including stop tangs which are arranged in relation to the latch tangs so that the former are capable of cooperating with a common secondary lock.

Other objects and features of the invention will become apparent to those skilled in the art as the disclosure is made in the following detailed description of a preferred embodiment of the invention as illustrated in the accompanying sheets of drawing in which.

Figure 1:
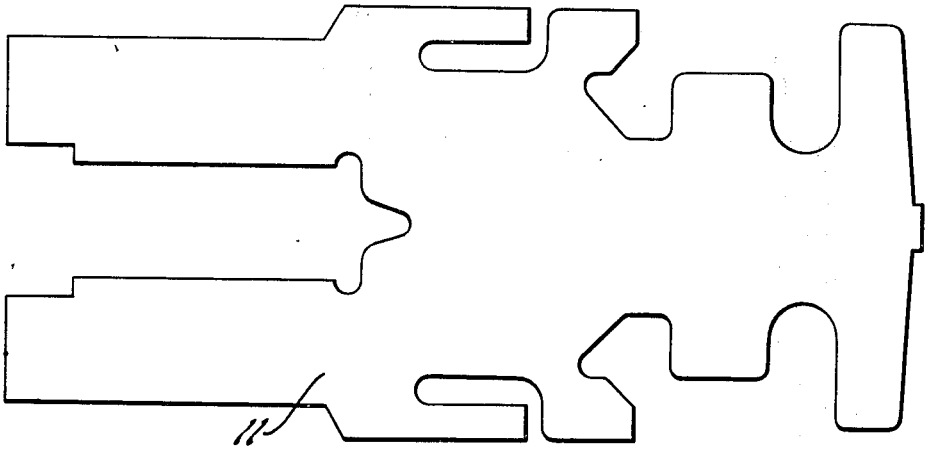
FIG. 1 is a plan view of a stamped blank for fabricating a terminal in accordance with this invention.
Figure 2:
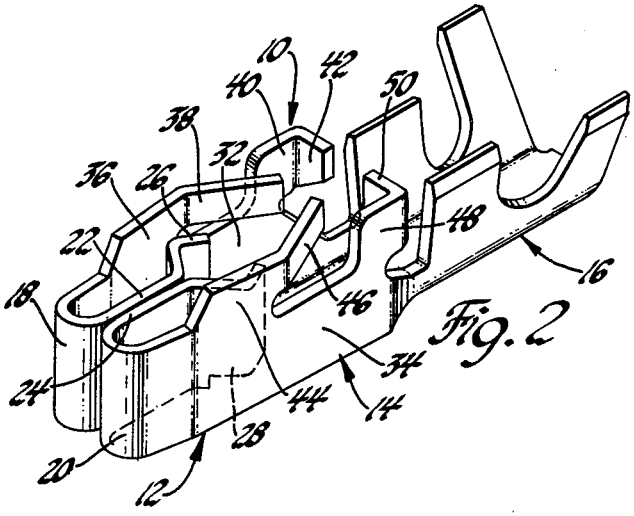
FIG. 2 is a perspective view of a terminal in accordance with this invention.
Figure 4:
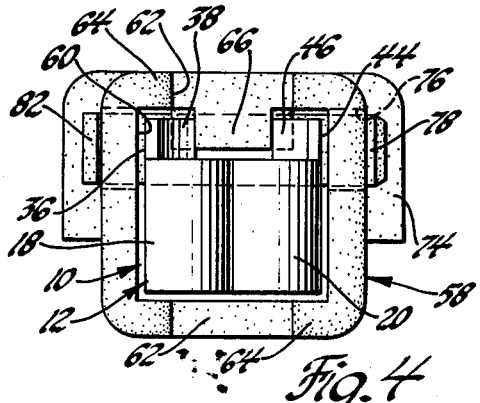
FIG. 4 is a front view of the terminal and connector body taken substantially along the line 4—4 of FIG. 3 looking in the direction of the arrows.
Figure 3:
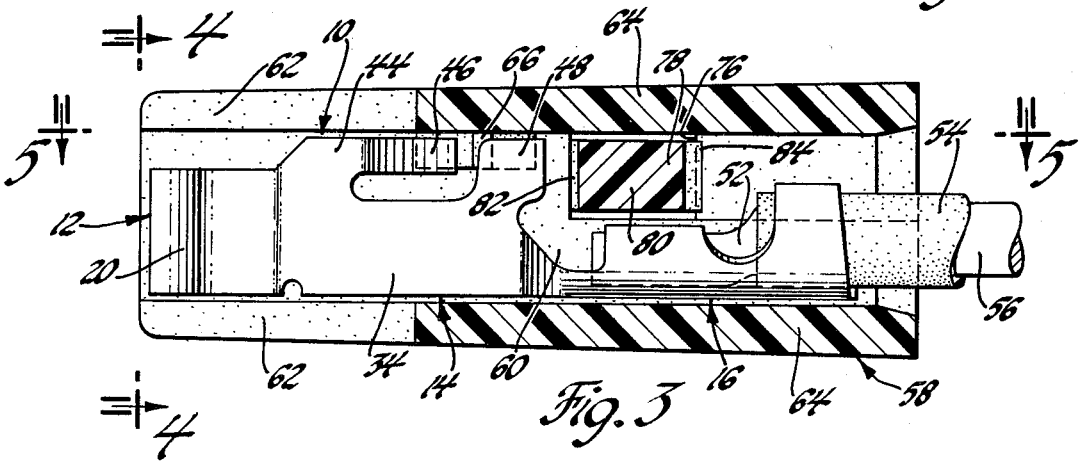
FIG. 3 is a longitudinal view, partially sectioned, showing the terminal of FIG. 2 locked in a terminal cavity of a connector body.

Referring now to the drawing and more particularly to FIG. 2, there is disclosed a female terminal 10 of unitary sheet metal construction which is made from the stamped blank 11 shown in FIG. 1 by conventional techniques. The female terminal 10 has a forward contact portion 12, a channel shaped median portion 14 and a rearward attachment portion 16.

Figure 5:
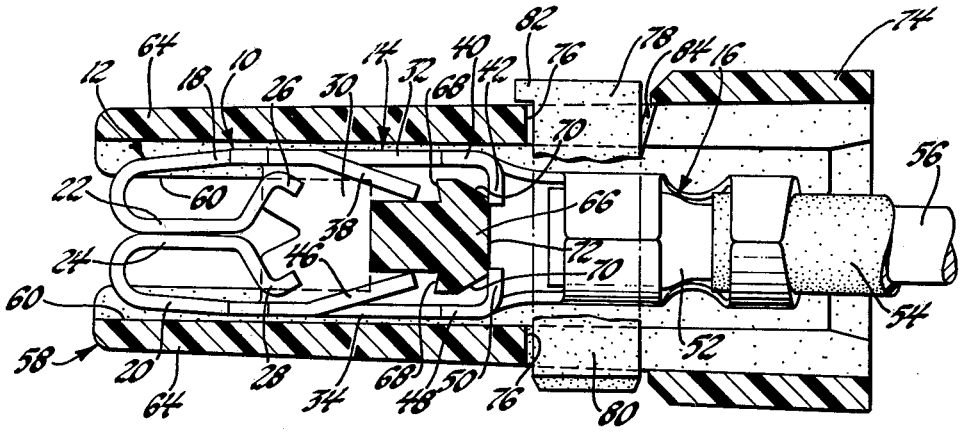
FIG. 5 is a section taken substantially along the line 5—5 of FIG. 3 looking in the direction of the arrows.
Figure 6:
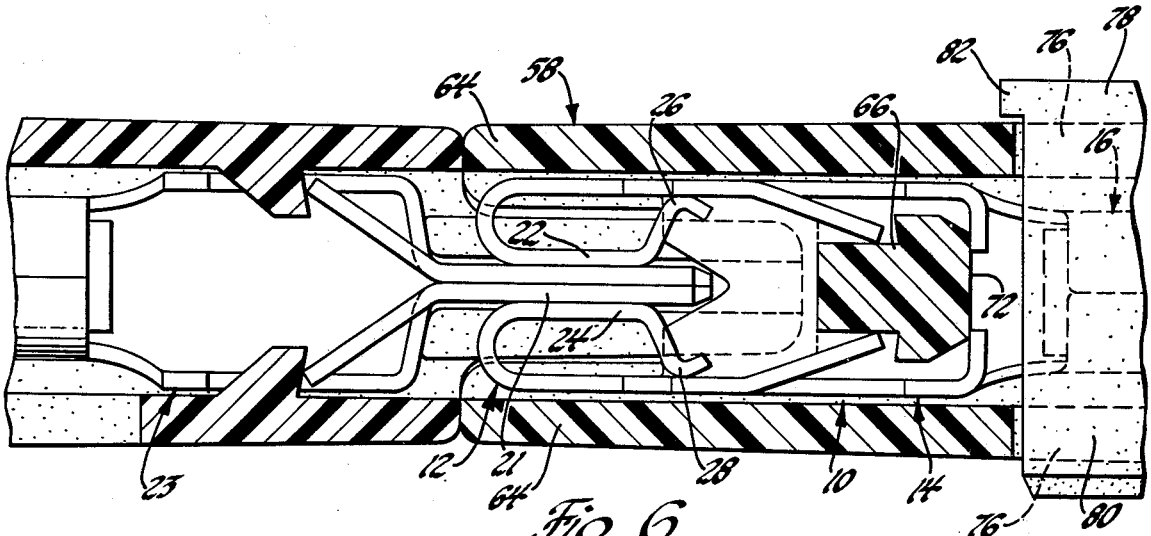
FIG. 6 is a view similar to FIG. 5 showing the terminal and connector body of FIG. 5 attached to a mating terminal and connector body.

The forward contact portion 12 comprises two U-shaped longitudinal arms 18 and 20. As best seen in FIG. 5, the outer legs of the U-shaped arms 18 and 20 converge slightly in the forward direction to accommodate the arms 18 and 20 being spread apart in the connector body when a blade contact portion 21 of a mating male terminal 23 is received between the inner legs 22 and 24 as shown in FIG. 6. The rearward ends of the legs 22 and 24 terminate in outward hook portions 26 and 28 which are engageable with the median portion 14 to limit the amount that the legs 22 and 24 can be spread apart.

The channel shaped median portion 14 comprises a web 30 and parallel side walls 32 and 34 to which the outer legs of the U-shaped longitudinal arms 18 and 20 are respectively connected.

Each of the side walls 32 and 34 has a latch tang and a stop tang associated with it. All four tangs are offset laterally of the forward contact portion 12 to the same side opposite the web 30 and the stop tangs are behind the latch tangs.

More particularly the side wall 32 has an associated latch tang comprising a coplanar lateral extension 36 at the rear edge of which is a resilient longitudinally inclined latch finger 38 which extends inwardly in the rearward direction. The side wall 32 has a second coplanar lateral extension 40 which is located rearwardly to latch finger 38 and at the rearward edge of which is an inwardly bent, relatively rigid tab 42.

The associated latch tang of the side wall 34 likewise comprises a coplanar lateral extension 44 at the rear edge of which is a resilient longitudinally inclined latch finger 46 which extends inwardly in the rearward direction. The latch finger 46 is located at the same longitudinal position as the latch finger 38. The side wall 34 also has a second coplanar lateral extension 48 which is located rearwardly of latch finger 46 and at the rearward edge of which is an inwardly bent, relatively rigid tab 50. The tabs 42 and 50 are coplanar for cooperation with a common stop surface and a common lock bar as will hereinafter more fully appear.

The attachment portion 16 comprises core and jacket crimp wings which are crimped to the core 52 and insulation 54 respectively of an electrical wire 56 in conventional manner.

The terminal 10 attached to the electrical wire 56 is illustrated in conjunction with a single cavity connector body 58 in FIGS. 3, 4, 5 and 6. The connector body 58 is generally rectangular in shape. It has a single rectangular open ended terminal cavity 60 which communicates with transverse slots 62 in one pair of side walls 64 at the mating end. One of the side walls 64 has a depending block 66 which projects into a median portion of the cavity 60 a short distance. The block has two forward notches which provide latch shoulders 68, and two ramps 70 on opposite sides of a common rear stop surface 72.

The connector body 58 has an offset enlargement 74 at the wire end which facilitates molding aligned cross apertures 76 extending through the connector body 58. The cross apertures 76 are located behind the rigid tabs 42 and 50 when the terminal 10 is properly positioned and locked in the cavity 60 by the latch fingers 38 and 46 and the rigid tabs 42 and 50 in conjunction with the projecting block 66.

The cross apertures 76 receive a lock bar 78 which is assembled to the connector body 58 after the terminal 10 is locked in place. The lock bar 78 has a rectangular shank 80 which extends through the cross apertures 76 and the cavity 60 behind the rigid tabs 42 and 50 to provide a secondary positive lock which prevents pull-out of the terminal 10 should the latch fingers 38 and 46 prove inadequate for one reason or another. The lock bar 78 is retained in assembly with the connector body 58 by an external head 82 and a flexible lock arm 84.

We wish it to be understood that we do not desire to be limited to the exact details of construction shown and described, for obvious modifications will occur to a person skilled in the art.

What is claimed is:

1. In a terminal having a forward contact portion comprising a pair of longitudinal arms adapted to receive a contact portion of a mating terminal therebetween, a channel shaped median portion having a web and a pair of side walls to which the longitudinal arms are respectively connected and a rearward attachment portion; the improvement comprising anti-tangle tang means for locking the terminal in a connector body, comprising:

a latch tang and a stop tang associated with each side wall of the median portion, each latch tang comprising a first lateral extension of the associated side wall at the side opposite the web, and a resilient longitudinally inclined latch finger at the rearward edge of the first lateral extension which extends inwardly of the channel shaped median portion and is offset from the forward contact portion in the lateral direction, and each stop tang comprising a second lateral extension of the associated side wall at the side opposite the web and an inwardly bent relatively rigid tab at the rearward edge of the second lateral extension, said stop tangs being located rearwardly of the latch tangs and in longitudinal alignment therewith.

2. In a terminal having a forward contact portion comprising a pair of longitudinal arms adapted to receive a contact portion of a mating terminal therebetween, a channel shaped median portion having a web and a pair of side walls to which the longitudinal arms are respectively connected and a rearward attachment portion; the improvement comprising anti-tangle tang means for locking the terminal in a connector body, comprising:

a latch tang and a stop tang associated with each side wall of the median portion, each latch tang comprising a first coplanar lateral extension of the associated side wall at the side opposite the web, and a resilient longitudinally inclined latch finger at the rearward edge of the first lateral extension which extends inwardly of the channel shaped median portion and is offset from the forward contact portion in the lateral direction, and each stop tang comprising a second coplanar lateral extension of the associated side wall at the side opposite the web and an inwardly bent relatively rigid tab at the rearward edge of the second lateral extension which is offset from the forward contact portion in the lateral direction, said tabs being located rearwardly of the latch tangs and coplanar with each other.

3. In a terminal having a forward contact portion comprising a pair of longitudinal arms adapted to receive a contact portion of a mating terminal therebetween, a channel shaped median portion having a web and a pair of side walls to which the longitudinal arms are respectively connected and a rearward attachment portion; the improvement comprising anti-tangle tang means for locking the terminal in a connector body, comprising:

a latch tang and a stop tang associated with each side wall of the median portion, each latch tang comprising a first coplanar lateral extension of the associated side wall at the side opposite the web, and a resilient longitudinally inclined latch finger at the rearward edge of the first lateral extension which extends inwardly of the channel shaped median portion and is offset from the forward contact portion in the lateral direction, and each stop tang comprising a second coplanar lateral extension of the associated side wall which is at the side opposite the web and spaced rearwardly of the inclined latch finger, and an inwardly bent relatively rigid tab at the rearward edge of the second lateral extension, said tabs being coplanar with each other and in longitudinal alignment with their associated latch fingers.

* * * * *